United States Patent [19]

Son

[11] Patent Number: 5,025,189

[45] Date of Patent: Jun. 18, 1991

[54] DYNAMIC FOCUSING ELECTRON GUN

[75] Inventor: Wan-jae Son, Cheonan, Rep. of Korea

[73] Assignee: Samsung Electron Devices Co., Ltd., Rep. of Korea

[21] Appl. No.: 431,250

[22] Filed: Nov. 3, 1989

[30] Foreign Application Priority Data

Nov. 5, 1988 [KR] Rep. of Korea ..... 88-14575

[51] Int. Cl.[5] ..... H01J 29/50

[52] U.S. Cl. ..... 313/414; 313/449

[58] Field of Search ..... 313/414, 449; 315/382, 315/15

[56] References Cited

U.S. PATENT DOCUMENTS 4,701,678 10/1987 Blacker et al. ..... 313/449 X
4,704,565 11/1987 Blacker et al. ..... 315/382
4,771,216 9/1988 Blacker et al. ..... 315/382
4,814,670 3/1989 Suzuki et al. ..... 313/414 X
4,825,120 4/1989 Takahashi et al. ..... 313/414

FOREIGN PATENT DOCUMENTS 3741202 6/1988 Fed. Rep. of Germany ..... 313/414
18348 2/1981 Japan ..... 313/414

*Primary Examiner*—Palmer C. DeMeo
*Attorney, Agent, or Firm*—Leydig, Voit & Mayer

[57] ABSTRACT

A dynamic focusing electron gun for high resolution includes a triode part and a main lens. The main lens includes a first focusing electrode disposed proximate the triode part, a second focusing electrode disposed proximate an anode electrode, a static potential electrode and a dynamic potential electrode disposed between the first and second focusing electrodes to form a dynamic quadrupole lens. The dynamic focusing electron gun produces a high resolution image with a small radius beam spot with low astigmatism, low spherical aberration, and good voltage endurance characteristics.

4 Claims, 5 Drawing Sheets

DYNAMIC FOCUSING ELECTRON GUN

FIELD OF THE INVENTION

The present invention relates to a dynamic focusing electron gun, especially to one which can improve the resolution of a cathode ray tube with low astigmatism.

BACKGROUND OF THE INVENTION

Among the dynamic focusing electron guns, there is one which has a quadrupole lens as shown in FIG. 1. Said the electron gun comprises a prepositioned triode part consisting of cathode K, control grid G1 and screen grid G2, and a main lens system consisting of focusing electrode E1, dynamic electrode E2 and anode E3 which respectively receive a static focusing voltage, a dynamic focusing voltage, and a static anode high voltage.

On the beam exiting side of said focusing electrode E1 and on the beam entrance side of said dynamic electrode E2, vertically elongate beam passing holes H1 and laterally elongate beam passing holes H2 respectively are disposed facing each other to form a quadrupole lens. On the beam exiting side of said electrode E2 and on the beam entrance side of said anode E3, elongate common beam passing holes H2' and H3 are disposed. Isolating metal ribs 12, 12 and I3, I3 are vertically attached to the exit and entrance sides of the electrode E2 and the anode E3, respectively, to form three separate beam passing zones in holes H2' and H3.

Besides, in a conventional dynamic focusing electron gun constructed as described above, the dynamic electrode receives a parabolic dynamic focusing voltage which is synchronized with the horizontal and vertical scanning signals according to the scanning position of electron beam. The dynamic focusing voltage is applied to the dynamic electrode in addition to a static potential focusing voltage in such a manner that, when the electron beam lands on the central part of the screen, a dynamic voltage Vd of OV or low positive potential is applied, and when the electron beam lands on the periphery of screen, a high potential dynamic voltage is applied. Therefore, whether or not a quadripole dynamic lens is formed between the focusing electrode E1 and the dynamic electrode E2 is determined by the landing position of the electron beam. Thus, when a quadrupole lens is formed when the electron beam is scanned on the periphery of the screen, the electron beam becomes vertically elongated by the asymmetrical dynamic electric field formed by the vertically elongate beam passing holes H1,H1,H1 and laterally elongate beam passing holes H2,H2,H2.

The vertically elongated electron beam scanned toward the periphery of the screen passes through the deflection yoke for rectification of the distortion of the beam by a non-homogeneous magnetic field, with the result that a nearly complete circular beam spot is formed on the screen. Moreover, when the electron beam lands on the periphery of the screen, said dynamic voltage rises and thereby the strength of final acceleration and focusing lens formed between the dynamic electrode and the anode becomes weaker.

Thus, the focal distance of the electron beam becomes longer so that the focus of the electron beam is formed on the periphery of the screen which is farther from the electron gun than the central part of the screen and the beam spot formed on the screen becomes very small, thereby realizing high resolution of image.

However, there are shortcomings in the conventional dynamic focusing electron gun in that it is difficult to realize a voltage controlling device which can endure the high parabolic dynamic voltage, the static focusing, voltage must be applied to the dynamic electrode, and an arc may occur at the neck of the cathode ray tube by the leakage of current due to the high voltage. Further, the conventional dynamic focusing electron gun has two focusing electrodes, and therefore the magnification of the major lens which finally accelerates and focuses the electron beam must be increased. Thus, there is a fear that the quality of image will become worse because of spherical aberration due to the high magnification of the major lens.

SUMMARY OF THE INVENTION

The object of the present invention is to provide a dynamic focusing electron gun in which the reliability and the quality of image are highly improved by improved voltage endurance characteristics, low astigmatism, and low spherical aberration.

To achieve the above object, the dynamic focusing electron gun according to the present invention comprises the triode including a cathode, control grid and screen grid, and a main lens system including electrodes which form a dynamic quadrupole focusing lens, wherein said main lens includes a first focusing electrode, a second focusing electrode, a static electrode, and a dynamic electrode, said first focusing electrode being disposed close to the screen grid and said second focusing electrode being disposed close to the anode which is the final acceleration electrode, said static electrode and dynamic electrode being disposed between said first and second focusing electrodes to form the dynamic quadrupole lens.

BRIEF DESCRIPTION OF THE DRAWINGS

The above objects and other advantages of the present invention will become more apparent by describing the preferred embodiment of the present invention with reference to the attached drawings in which.

DETAILED DESCRIPTION OF THE INVENTION

Figure 1:
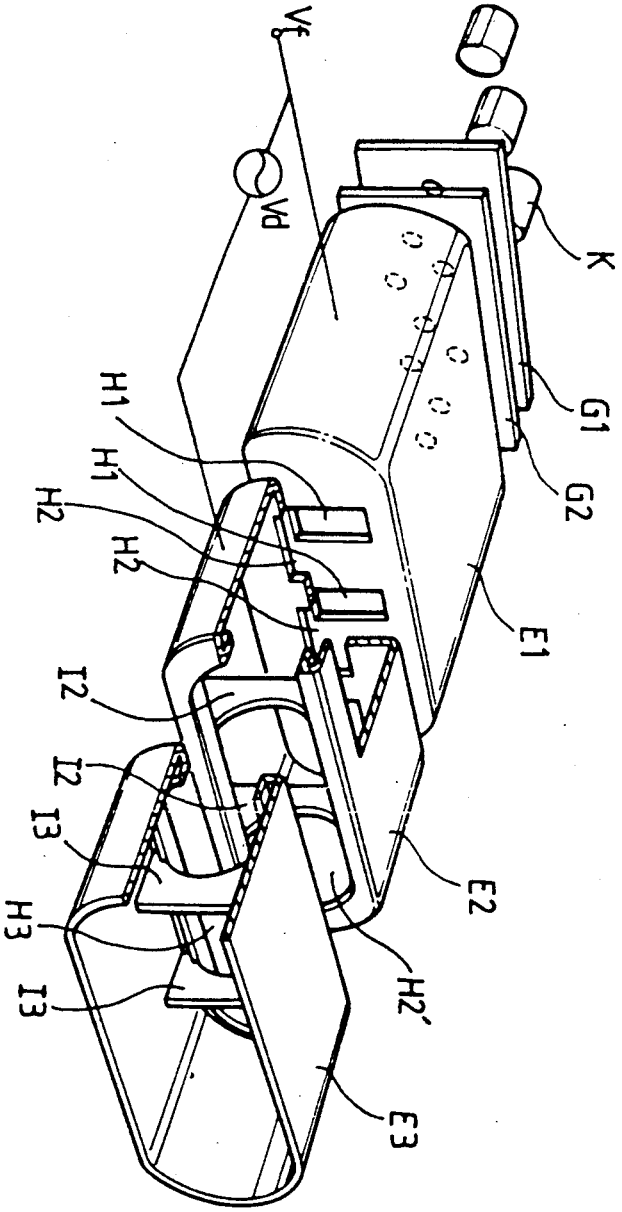
FIG. 1 (Prior Art)
FIG. 1 is a partially sectional perspective view of a conventional dynamic focusing electron gun.
Figure 2:
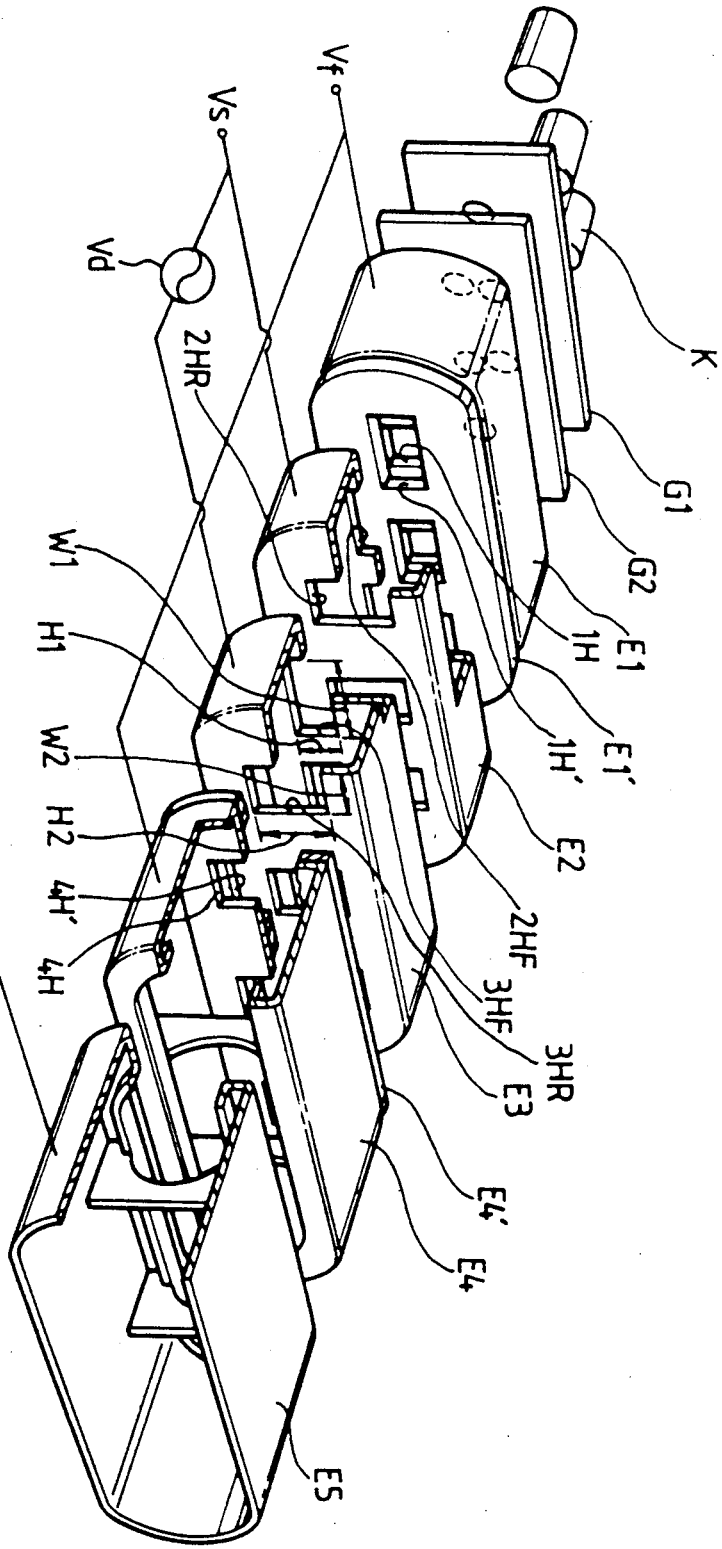
FIG. 2 is a partially sectional perspective view of a dynamic focusing electron gun according to the present invention.

FIG. 2 illustrates a dynamic focusing electron gun according to the present invention, which comprises cathodes k, a control grid G1, a screen grid G2, and a main lens system comprising a first focusing electrode E1, a static potential electrode E2, a dynamic potential electrode E3, a second focusing electrode E4, and an anode E5.

On the electron beam entrance side of said static potential electrode E2 and dynamic potential electrode E3, three laterally elongate rectangular beam passing holes 2HF and 3HF whose vertical dimensions are H1 and lateral widths are W1 are formed, respectively. On the electron beam exiting side of the electrodes E2 and E3 three vertically elongate rectangular beam passing holes 2HR and 3HR of vertical dimensions H2 and lateral widths W2 are formed, respectively. Plate-shaped vertical dimensions and the lateral widths of said beam passing holes can be expressed as below.

$$H1 < H2,\ W2 < W1,\ H1 = W2 \text{ and } H2 = W1$$

Meanwhile, on the electron beam exiting side of said first focusing electrode E1 and on the electron beam entrance side of said second focusing electrode E4, three vertically elongate rectangular beam passing holes 1H, 4H of vertical dimensions H1 and lateral width W2 are formed, respectively. The auxiliary electrodes E1' and E4' with laterally elongate beam passing holes 1H' and 4H', respectively, are attached to the beam exiting and entrance sides of first and second electrodes E1 and E4 respectively, with the beam passing holes overlapped. Here, the upper and lower edges of the beam passing holes overlapping each other are in alignment and the right and left edges thereof are not aligned, as illustrated in FIG. 2.

The voltage is applied to each electrode of said dynamic focusing electron gun of the present invention in the way described below. A high potential electrostatic focusing voltage Vf is applied to the first focusing electrode E1 and the second focusing electrode E4, and a static focusing voltage Vs, lower than said focusing voltage Vf, is applied to said static potential electrode E2. A parabolic dynamic voltage Vd is applied to said dynamic potential electrode E3 together with said static voltage Vs. Meanwhile, an anode voltage Va, higher than said focusing voltage Vf, is applied to said anode E5.

Now the electron gun of the present invention will be described in more detail as to its functions and effects.

Figure 3A:
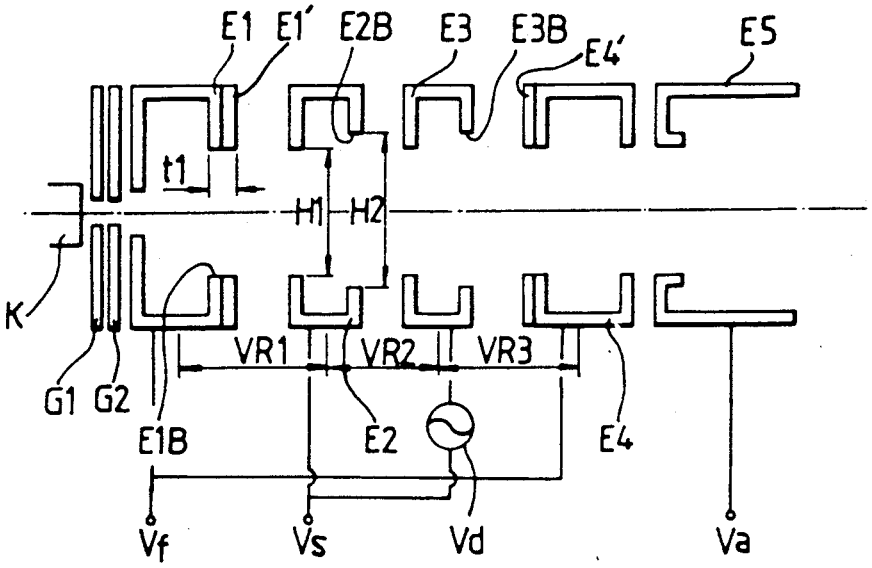
FIG. 3A is a side sectional view of the embodiment shown in FIG. 2.
Figure 4A:
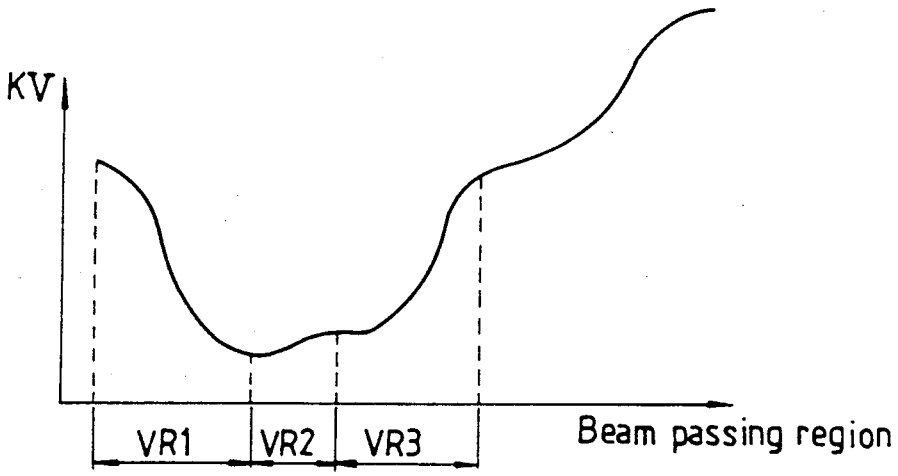
FIG. 4A is a graph representing the vertical distribution of electric potential in the embodiment shown in FIG. 2.

Firstly, referring to FIGS. 3A and 4A, an observation is made as to the control of the electron beam in the vertical direction.

In the VR1 area of FIG. 3A, a diverging lens is formed which is stronger in the vertical direction than in the lateral direction both by the beam passing hole 1H of the first focusing electrode E1 and the laterally elongate beam passing hole 1H' which overlaps said beam passing hole 1H. This is due to the fact that the voltage is rapidly decreased as shown in FIG. 4A by the laterally elongate beam passing hole 1H' whose lateral width is substantially equivalent to the vertical dimension of the beam passing hole of the first focusing electrode E1.

And in the VR2 area, a quadrupole lens is formed by the static potential electrode E2 and dynamic potential electrode E3, of which the strength constantly varies according to the magnitude of dynamic voltage Vd applied to the dynamic potential electrode E3. So if the dynamic voltage Vd is greater than OV, a quadrupole lens having a strong diverging force and a weaker focusing force in the vertical direction is formed by the vertically elongate beam passing holes 2HR of the static potential electrode E2 and the laterally elongate beam passing holes 3HF of the dynamic potential electrode E3. Then, if the dynamic voltage is OV, a quadrupole lens is not formed because the same potential voltage is applied both to the static potential electrode E2 and the dynamic potential electrode E3.

In the VR3 area, a strong diverging lens having stronger diverging force in the vertical direction is formed even though there is a little difference in strength according to the magnitude of the dynamic voltage Vd.

Figure 3B:
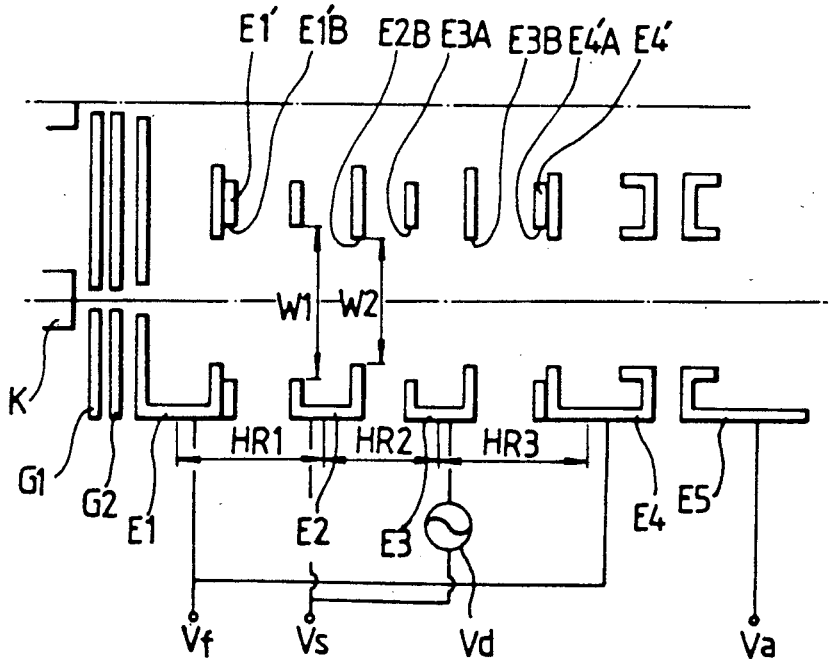
FIG. 3B is a plan sectional view of the embodiment shown in FIG. 2.
Figure 4B:
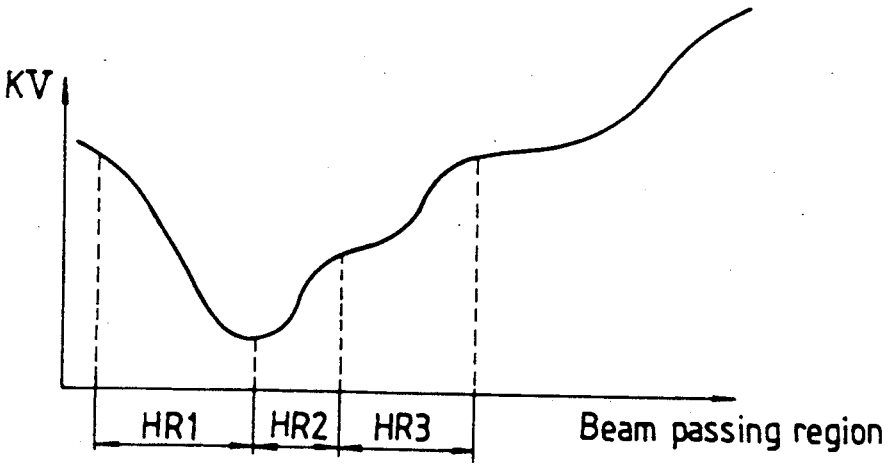
FIG. 4B is a graph illustrating the horizontal distribution of electric potential in the embodiment shown in FIG. 2.

Next, referring FIG. 3B and 4B, the control of the electron beam in the lateral direction is explained.

In the HR1 area, a diverging lens is formed which is weaker in the horizontal direction by the auxiliary electrode E1' having laterally elongate beam passing holes 1H' and attached to the first focusing electrode E1.

In the HR2 area, if the dynamic voltage is applied to the dynamic electrode E2, that is, if Vd is greater than zero, then a quadrupole lens having a stronger focusing force and weaker diverging force in the lateral direction is formed between the static potential electrode 14 and the dynamic potential electrode 15.

In HR3 area, a focusing lens is formed having a stronger focusing force in the lateral direction even though there is a little difference in strength according to the magnitude of the dynamic voltage Vd.

Subsequently, the resultant control of the electron beam passing through the beam passing areas will be described, referring FIGS. 5A and 5B the upper half of which represents the path of the electron beam in the vertical direction and lower half represents that path in the horizontal direction.

Figure 5A:
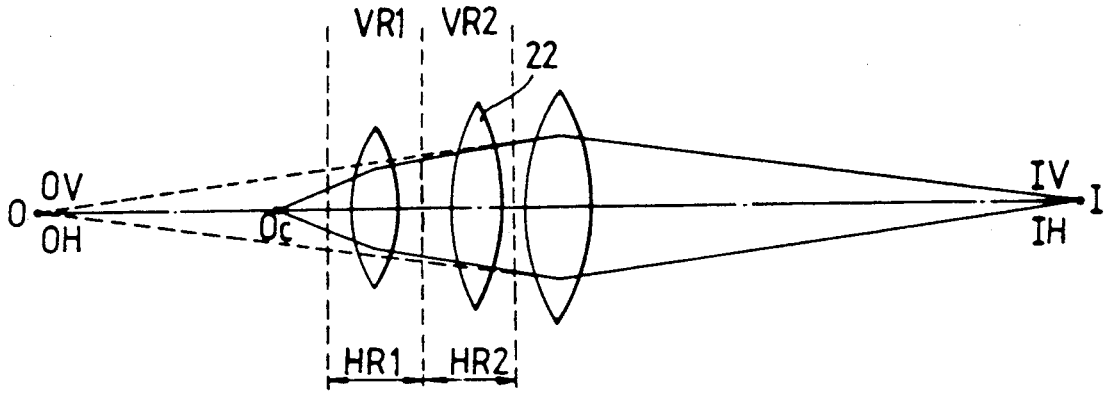
FIGS. 5A, 5B illustrate the focusing of the electron beam when the dynamic voltage is applied to the dynamic focusing electron gun shown in FIG. 2, FIG. 5A illustrating the case of $Vd=O$, and FIG. 5B illustrating the case of $Vd>O$.

In case Vd equals zero, the focusing status of the electron beam is equal in the vertical and horizontal directions due to the fact that the lens 22 of same focusing force in vertical and horizontal direction is formed in the HR2, VR2 area as shown in FIG. 5A. If Vd is greater than zero, focusing lens 21 is formed in the HR2 area in the horizontal direction in addition to the formation of diverging lens 20 in the VR2 area in the vertical direction as shown in FIG. 5B. Therefore, if Vd equals zero, the quadrupole lens is not formed in the VR2, HR2 area as shown in FIG. 5A so that the vertical and horizontal imaginary object points meet at the same point (O=OH=OV) and so do the image points (I=IH=IV).

Figure 5B:
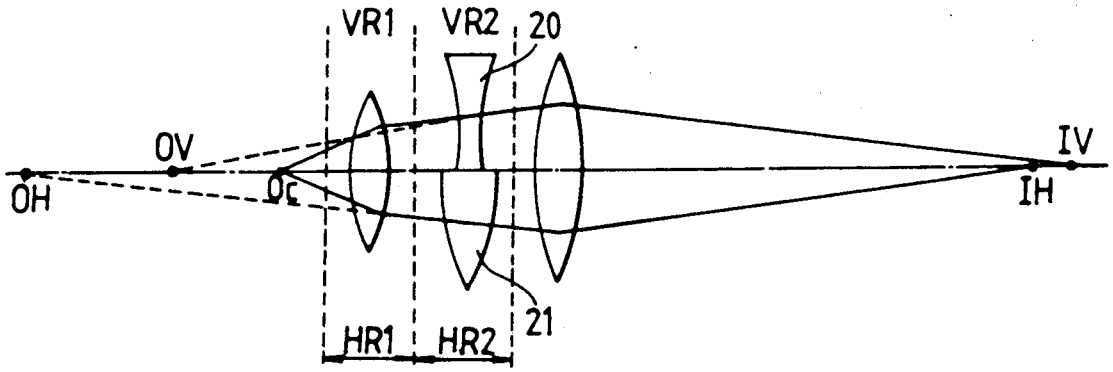

On the other hand, if Vd is greater than zero, then a quadrupole lens is formed in the VR2,HR2 area as shown in FIG. 5B so that the imaginary object point OH in the horizontal direction is formed farther from VR2,VR2' area than the vertical imaginary object point OV and the vertical image point IV is formed farther from HR2,HR2' area than the horizontal image point IH.

It is noted that, according to the present invention, the dynamic focusing electron gun is able to form homogeneous and nearly complete circular beam spots on the whole screen by controlling the electron beam according to the dynamic voltage synchronized with the deflection signal applied to the deflection yoke. Namely, the electron gun of the present invention focuses the electron beam in a normal state when the electron beam is scanned toward the central part of the screen and in a vertically elongated state when scanned to the periphery of the screen, so it is possible for the beam spot to become nearly completely circular when the electron beam lands on screen after passing through the deflection yoke's non-homogeneous magnetic field. Consequently, the realization of high image resolution is possible by improving the characteristics of the beam spot on the whole screen.

Meanwhile, with the electron gun of the present invention, it is possible for the electric potential of the the dynamic voltage applied to the dynamic potential electrode to be lower than the conventional electron gun due to the fact that the electron gun is provided with an electrostatic electrode and a dynamic electrode receiving a low voltage in addition to the focusing electrode receiving a high voltage so as to form a quadrupole lens for controlling the electron beam with a low intensity electric field. Therefore, the reliability of the cathode ray tube can be increased by removing the possibility of arc generation.

What is claimed is:

1. A dynamic focusing electron gun for producing a plurality of electron beams comprising a triode including a plurality of cathodes, a control grid, and a screen grid, and a main lens means including a plurality of electrodes for forming a dynamic quadrupole focusing lens for focusing the electron beams, said main lens means comprising a first focusing electrode disposed proximate said screen grid, a second focusing electrode disposed proximate a final acceleration anode, a static potential electrode disposed proximate said first focusing electrode, and a dynamic potential electrode, said static potential electrode and dynamic potential electrode being disposed between said first and second focusing electrodes and forming the dynamic quadrupole lens wherein said static potential electrode includes vertically elongate electron beam passing exit holes for passage of the electron beams out of said static potential electrode toward said dynamic potential electrode and said dynamic potential electrode includes laterally elongate electron beam passing entrance holes for passage of the electron beams into said dynamic potential electrode from said static potential electrode.

2. The dynamic focusing electron gun as claimed in claim 1 wherein said static potential electrode includes laterally elongate electron beam passing entrance holes for the passage of the electron beams into said static potential electrode from said first focusing electrode.

3. The dynamic focusing electron gun as claimed in claim 1 wherein said dynamic potential electrode includes vertically elongate electron beam passing exit holes for passage of the electron beams out of said dynamic potential electrode toward said second focusing electrode and said second focusing electrode includes vertically elongate electron beam passing entrance holes for the passage of the electron beams into said second focusing electrode from said dynamic potential electrode.

4. The dynamic focusing electron gun as claimed in claim 1 including a first plate-like auxiliary electrode attached to a side of said first focusing electrode from which the electron beams exit from said first focusing electrode and a second platelike auxiliary electrode attached to a side of said second focusing electrode where the electron beams enter said second focusing electrode, said first and second auxiliary electrodes each including laterally elongate electron beam passing holes.

* * * * *